United States Patent [19]

Wing

[11] 4,175,878

[45] Nov. 27, 1979

[54] PRINTER COVER ASSEMBLY

[75] Inventor: James W. Wing, Zumbro Falls, Minn.

[73] Assignee: International Business Machines Corporation, Armonk, N.Y.

[21] Appl. No.: 786,922

[22] Filed: Apr. 12, 1977

[51] Int. Cl.[2] ..... B41J 29/02

[52] U.S. Cl. ..... 400/693; 400/619

[58] Field of Search ..... 197/133 R, 145, 186 R, 197/186 A, 186 B

[56] References Cited

U.S. PATENT DOCUMENTS

| | | | |
|---|---|---|---|
| 1,485,297 | 2/1924 | Sandor | 197/186 R X |
| 2,210,569 | 8/1940 | Dobson | 197/186 R |
| 2,729,323 | 1/1956 | Jones | 197/145 |
| 3,334,722 | 8/1967 | Bernard | 197/133 R |

FOREIGN PATENT DOCUMENTS

| | | | |
|---|---|---|---|
| 2428006 | 4/1975 | Fed. Rep. of Germany | 197/186 R |

*Primary Examiner*—Ernest T. Wright, Jr.
*Attorney, Agent, or Firm*—Robert W. Lahtinen

[57] ABSTRACT

A cover structure is disclosed which is particularly adapted to a printer having a continuous forms tractor, as including two principal portions mounted on a base which are removable to the front and rear without disturbing the printer platen, the forms tractor or the paper supply resident in the forms tractor and the paper handling portion of the printer mechanism.

3 Claims, 5 Drawing Figures

PRINTER COVER ASSEMBLY

FIELD OF THE INVENTION

This invention pertains to printers and more particularly to covers for a printer including a roller platen and a continuous forms tractor.

BACKGROUND OF THE INVENTION

Cover assemblies have been utilized normally to conceal and protect the device mechanism and circuitry with which they are associated and to provide operator safety where a hazard might otherwise be present. In addition, functional considerations such as ventilation of the enclosed device must be accommodated. The cover hardware also affords the opportunity to enhance the esthetic appearance. Following such considerations it has been common to evaluate and make accommodation for the simplicity of mounting and securing the covers using appropriate hardware. Further it has been a design consideration to take into account the requirement for repositioning the cover structure for inspection and the total removal for any adjustments, repairs or replacements.

In the environment of a printer of the type commonly used with data processing equipment including a continuous forms tractor to render infrequent the loading of new paper supplies, there have been specific service problems that have not been reconciled with respect to the cover structure as regards the design and the mode of operation. It has been necessary in the past to remove the forms tractor as an incident of cover removal before any substantial part of the mechanism could be exposed for inspection, adjustment or repair. Although the paper tractor is nominally removable without great difficulty it still requires a substantial part of the service time since the normal procedure would be to remove the tractor, remove the covers, and reinstall the tractor for service purposes. When the servicing or repair is complete this process is reversed by removal of the tractor, reinstallation of the covers and thereafter reinstalling the tractor. In addition to the disabilities associated with the thus frequent disassembly and reinstallation of the tractor, the act of removing the tractor may impair the serviceability under some circumstances. Where the problem resides in the cooperation between the forms tractor and the associated paper handling portion of the printer, the disturbance of the total cooperating mechanism by tractor removal often renders difficult or impossible the identification of the problem. On other occasions the additional removal and reassembly of the tractor after service may reinstate an intermittent problem that was thought to be overcome or was undetectable in the disassembled state or as previously assembled during servicing.

SUMMARY OF THE INVENTION

In the cover structure of the present invention a two piece cover is used which is guided by and supported on a base member which also mounts and supports the printer mechanism. The front cover is disassembled by sliding forward, the rear cover is removed by rearward motion and both can be removed without disturbing either the forms tractor mounted on the printer with the principal portions thereof supported above the cover assembly or without removing or damaging the continuous paper form installed in the tractor and passing over the printer platen.

In addition to enabling disassembly without disturbing either the forms tractor or the printer platen the particular cover partitioning makes it possible to permit partial disassembly by removal of individual cover assembly portions for various purposes and also to introduce varying degrees of difficulty into the disassembly of the various portions. As shown, the front cover element includes a skirt or insert portion that is no more than lightly detented in place and is readily removable for routine operator functions such as ribbon removal and replacement. When it is desired to remove the roller platen, the front cover can be moved forward a sufficient amount to allow disconnection and removal of this portion. This can be achieved by interposing a stop that is engaged prior to front cover removal. A further step would permit the total removal of the front cover from the printer. Finally the most positive restraint would be applied to the retention of the rear cover that shrouds the principal electrical circuitry and power supply.

It is an object of the invention to provide a cover structure for a printer having a platen and continuous forms tractor which may be removed without disturbing or disassembling either such forms tractor or the platen. It is a further object of the invention to provide a cover structure that permits the printer platen to be removed without entirely removing any principal portion of the cover assembly. It is also an object of the invention to provide a multiple part cover design wherein varying degrees of ease or difficulty may be introduced with respect to the disassembly of the various parts.

The foregoing and other objects, features and advantages of the invention will be apparent from the following more particular description of a preferred embodiment of the invention, as illustrated in the accompanying drawing.

DETAILED DESCRIPTION

Figure 1:
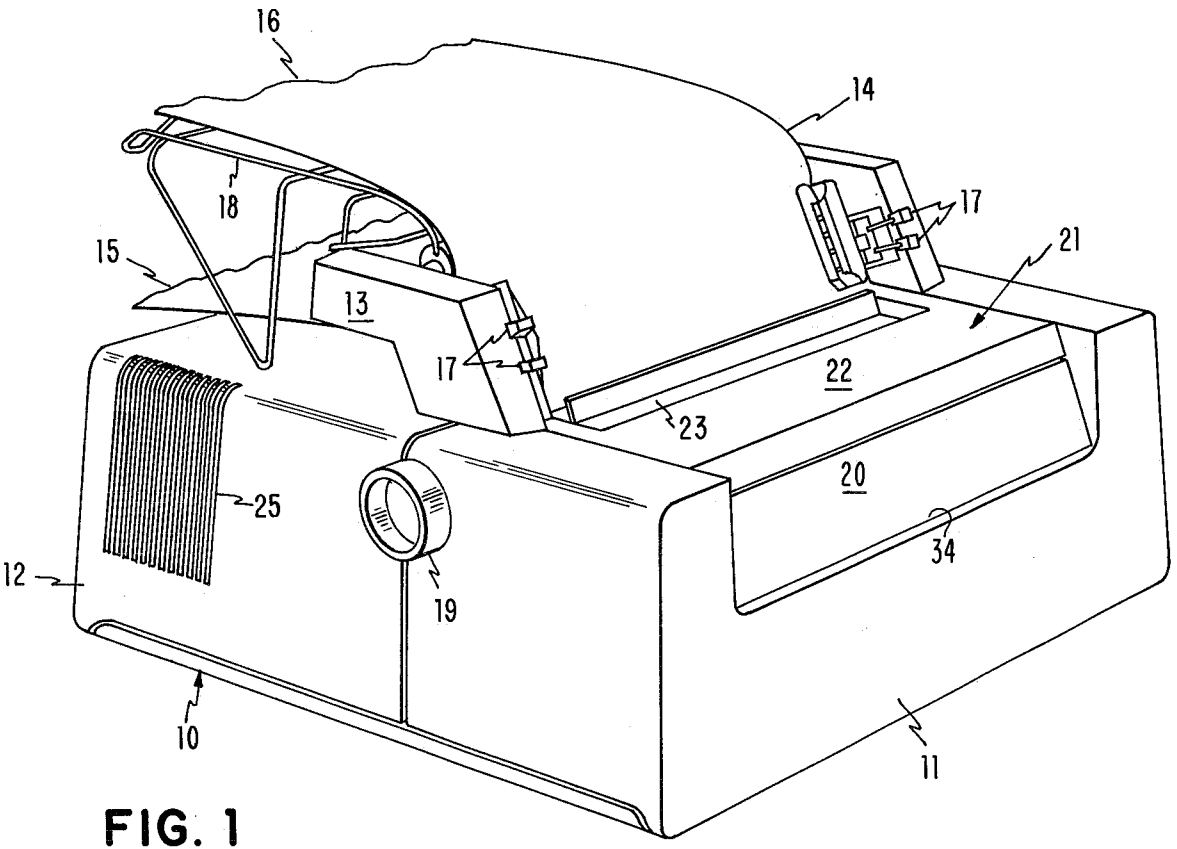
FIG. 1 shows the printer, paper tractor and cover assembly elements of this invention in the assembled condition.

FIG. 1 is an assembled illustration of the printer and cover assembly including a base 10, front cover 11, rear cover 12 and continuous form paper tractor 13. The continuous form paper web 14 has an entering portion 15 and an exiting portion 16. Two pairs of levers 17 are operative to adjust the paper drive pin feed mechanism of the paper tractor 13. A welded rod paper guide structure 18 is connected as a part of the paper tractor assembly and guides both incoming and outgoing paper web portions 15,16, but provides more extensive support for the outgoing upper web portion 16 subsequent to printing. Knob 19 is mounted on the printer platen shaft 64 for rotary movement in unison therewith to provide for manual operation of the roller platen 32 from outside the cover assembly structure. The front cover 11 has an opening 34 at the front through which an escutcheon plate 20 is exposed. The various switches and indicator lights associated with operator control and monitoring are mounted on this plate 20. An upper skirt 21 is supported on the front cover 11 and has an opaque forward portion 22 and a transparent rear portion 23 through which the print head assembly 54 and ribbon cartridge assembly 55 are visible. The skirt 21 is readily removable by the operator for such routine service as ribbon replacement. A series of slots or louvers 25 are provided in the rear cover 12 for ventilation of the printer, power supply and control circuit.

Figure 2:
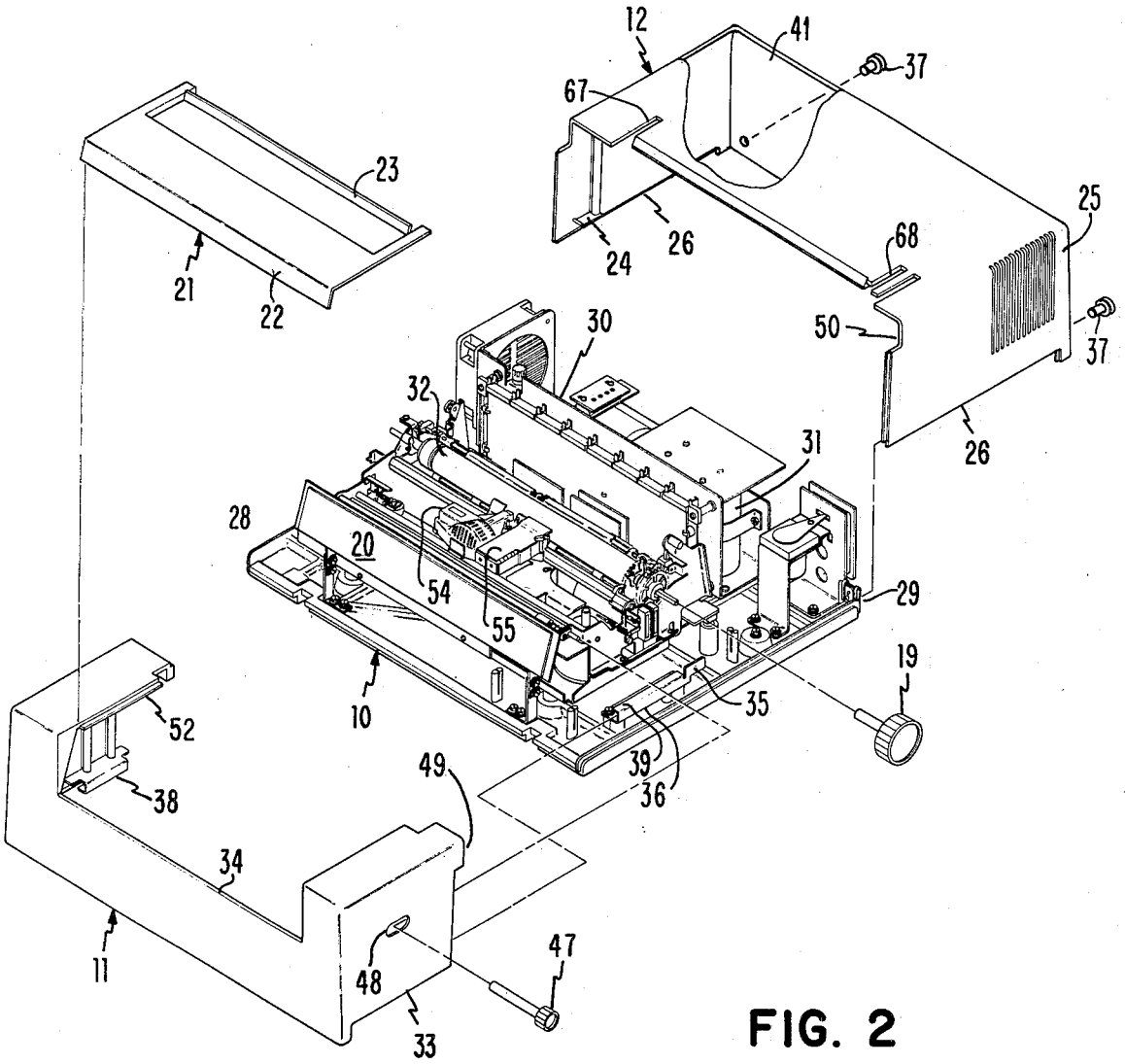
FIG. 2 illustrates the printer and the various cover elements of FIG. 1 in an exploded, disassembled condition.
Figure 3:
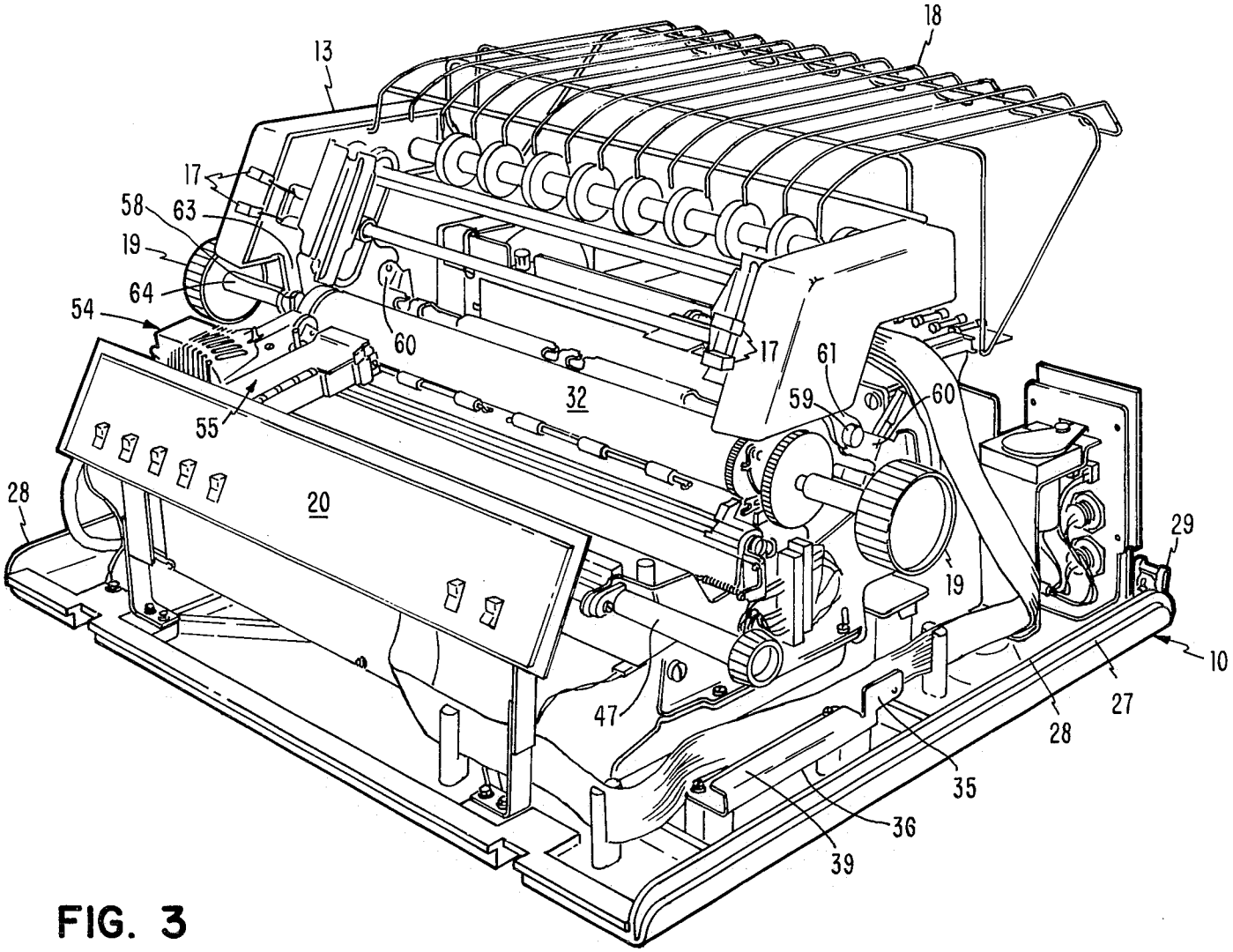
FIG. 3 is a perspective view of the printer mechanism, paper tractor and base with various cover elements removed.

FIGS. 2 and 3 show this printer with covers 11,12 removed. In FIG. 2 the relationship of covers 11,12 to the printer and base 10 are shown in the exploded view while FIG. 3 shows the printer mechanism with the paper tractor 13 mounted thereon. Rear cover 12 has a lower flange 26 at either side that is received and supported on the base member shoulder 27. The base member vertical flange 28 abuts the inside surface of 26 rear cover flange in the assembled condition to preclude lateral movement. In the assembled condition the rear cover 12 is secured in position by a pair of bolts 37 through the rear wall 41 which are received in a cooperating pair of Fahnstock clips 29 (one of which is shown) supported on base member 10. When these bolts 37 are removed rear cover 12 is removable from the base 10 and the printer assembly by a direct rearward movement without further disassembly and without disturbing either the paper tractor 13 or the paper web 14 carried thereby. At each interior surface of the rear cover flange 26 a horizontal ear 24 is attached which, in the fully assembled condition, underlies the projection 35 of one of the pair of guide elements 36 supported at each side of base 10. Each ear 24 being restrained beneath the cooperating projection 35 prevents upward movement of the forward end of the rear cover 12 in the assembled condition. The rear cover 12 serves to enclose the principal circuit elements such as those carried on circuit board 30 and power supply elements partially shown at 31.

The front cover 11 similarly has flanges 33 at each side that are respectively received on base member shoulders 27 and confined against lateral movement by base flange 28. Mounted on each of the front cover interior wall surfaces are a pair of cooperating guide channels 38 which present outwardly facing channels that have interlocking cooperation with the inwardly facing channel portions 39 of base member mounted guide elements 36 to permit assembly by a rearward motion of the cover 11 and disassembly by a forward motion of cover 11.

Figure 4:
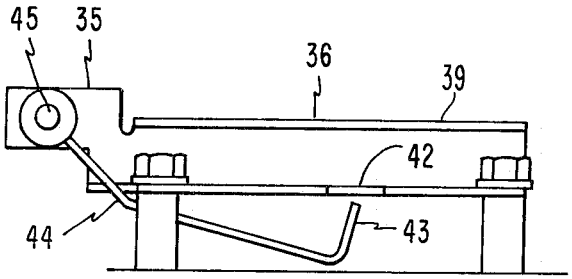
FIG. 4 is a side elevation of the base member supported guide element illustrating the interlock lever assembly.
Figure 5:
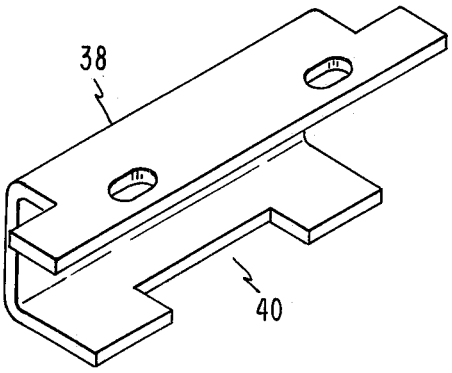
FIG. 5 is an isometric view of cover mounted guide element that cooperates with the guide of FIG. 4 showing the lost motion slot.

Referring to FIG. 5 it will also be noted that the guide channels 38 have a slotted recess 40 in the lower flange. Referring also to FIG. 4, it will be seen that when the front cover 11 is installed with the guide channels 38 received in the guide element 36 channel portions 39, the slotted recess 40 overlies flange opening 42 into which the turned end 43 of lever 44 may be introduced. The lever 44 is pivoted about a pin 45 on projection 35. The front cover 11 is so installed prior to the assembly of the rear cover 12. When the rear cover 12 is then inserted into the installed position with the ear 24 held captive beneath projection 35, the ear 24 also engages lever 44 causing it to pivot upwardly and move the turned end through opening 42 and into the slotted recess 40. With the lever turned end 43 thus positioned and the rear cover 12 bolted in position, removal of the front cover 11 is precluded. However, because of the length of slot 40, limited forward movement of front cover 11 is allowed. It will also be observed that the shaft projection and knob 47 used to adjust printer character position, is received in an elongated opening 48 in the front cover side wall. This slotted opening 48 also permits the limited movement afforded by guide slot 40 without removal of knob 47.

The limited forward motion of front cover 11 without removal of rear cover 12 permits the front cover projection 49 to move sufficiently forward to allow removal of the rollar platen 32 in cooperation with the rear cover recess 50. Thus, with this limited motion of the front cover 11 both the paper tractor 13 and the platen 32 can be removed without further disassembly of the cover elements.

The skirt 21 rests on front cover inwardly facing flanges 52 and is readily removable to allow access to such elements as the print head assembly 54 and the ribbon cartridge assembly 55.

As shown in FIG. 3, the paper tractor 13, on which is supported the forms guide rack 18, is mounted on the printer assembly independent of either the front cover 11 or rear cover 12. A pair of coaxial pins 59 (one of which is shown) project respectively outwardly from and are rigidly connected to printer assembly brackets 60. Paper tractor brackets 61 extend through slots 67, 68 (FIG. 2) and are journaled about pins 59 permitting the tractor 13 and guide rack 18 to pivot in unison about the axis of such pins 59. The tractor 13 is also supported by a pair of depending resilient elements 63 (one of which is visable) that extend through slots 67, 68 and terminate in a downwardly facing curved surface 58 that rests on and is supported by platen shaft 64.

In summary, the paper tractor 13 and its various component parts including the paper guide rack 18 is mounted on the print mechanism independent of either the front cover 11 or rear cover 12. The continuous forms paper tractor 13 and the paper web 14 installed therein may be removed or installed without disturbing the front cover 11 or rear cover 12 and likewise either front cover 11 or rear cover 12 may be removed without disturbing the paper tractor 13 or installed paper web 14. The cover elements that shroud the mechanism and the electrical components may be removed selectively with varying degrees of difficulty interposed. The skirt 21 is readily removable for such routine operator activity as ribbon changing. With the forms tractor 13 removed, the roller platen 32 may be accessed and removed by the limited forward movement afforded by the interlock system. Finally by removing the securing bolts 37 from the rear cover rear wall and limited rearward movement of the rear cover 12 to disengage the interlock lever 44, either or both the front cover 11 and rear cover 12 may be totally removed and such removal can be accomplished without disturbing the paper tractor 13 or the paper web 14 therein.

While the invention has been particularly described with reference to a specific embodiment, it will be understood by those skilled in the art that various changes in form and detail may be made therein without departing from the spirit and scope of the invention.

What is claimed is:

1. A printer having a print mechanism, a roller platen and a continuous form paper tractor for moving a continuous paper web over said platen comprising a base member which is connected to and supports said print mechanism;

a cover assembly that shrouds at least a portion of said print mechanism;

said cover assembly having front and rear sections supported on said base member and abutting one another along an interface surface;

slotted opening means formed in said cover assembly extending from said interface surface;

support means carried by said paper tractor which extend through said slotted opening means and are connected to said print mechanism whereby said paper tractor is supported exterior of said cover assembly sections;

releaseable retaining means for securing said cover assembly front section and said cover assembly rear section to said base member;

said front section being removeable from said base member in a forward direction, upon release of said releaseable retaining means, without removal or disassembly of said paper tractor and said rear section being removeable from said base member in a rearward direction, upon release of said releaseable retaining means, without removal or disassembly of said paper tractor;

whereby said cover assembly can be removed from said base member to expose said print mechanism without removal or disassembly of said paper tractor.

2. The printer of claim 1 further comprising interlock means for preventing removal of one of said cover assembly sections when the other of said cover assembly sections is releaseably secured to said base member.

3. The printer of claim 2 wherein said interlock means includes a lost motion connection means for limiting motion of said one of said cover assembly sections in the direction of removal when said other of said sections is releaseably secured to said base.

* * * * *